US006563411B1

(12) United States Patent
Otte et al.

(10) Patent No.: US 6,563,411 B1
(45) Date of Patent: May 13, 2003

(54) CURRENT TRANSFORMER WITH DIRECT CURRENT TOLERANCE

(75) Inventors: Detlef Otte, Gruendau (DE); Joerg Petzold, Bruchkoebel (DE)

(73) Assignee: Vacuumschmelze GmbH, Hanau (DE)

( * ) Notice: Subject to any disclaimer, the term of this patent is extended or adjusted under 35 U.S.C. 154(b) by 0 days.

(21) Appl. No.: 09/787,296

(22) PCT Filed: Sep. 16, 1999

(86) PCT No.: PCT/DE99/02955

§ 371 (c)(1),
(2), (4) Date: May 4, 2001

(87) PCT Pub. No.: WO00/17897

PCT Pub. Date: Mar. 30, 2000

(30) Foreign Application Priority Data

Sep. 17, 1998 (DE) ..... 198 42 710

(51) Int. Cl.[7] ..... H01F 27/08

(52) U.S. Cl. ..... 336/60; 336/173; 336/177; 336/182; 428/544; 428/546; 148/400; 148/304; 148/306; 420/121

(58) Field of Search ..... 336/60, 173, 177, 336/182, 220; 420/8, 14, 16, 18, 121; 428/544, 546, 610; 148/400, 304, 306

(56) References Cited

U.S. PATENT DOCUMENTS 4,668,310 A 5/1987 Kudo et al.

FOREIGN PATENT DOCUMENTS

| | | |
|---|---|---|
| DE | 2824749 | 12/1979 |
| DE | 3415435 | 10/1984 |
| DE | 3422281 | 12/1984 |
| DE | 19653428 | 3/1998 |
| DE | 196534228 | 3/1998 |
| EP | 0240600 | 10/1987 |
| EP | 0360574 | 3/1990 |

OTHER PUBLICATIONS

Patent Abstracts of Japan, vol. 011, No. 343 (E–555), Nov. 10, 1987.
Japanese Patent Abstract 62–124703, Jun. 6, 1987.
Patent Abstracts of Japan, vol. 011, No. 161 (E–509), May 23, 1987.
Japanese Patent Abstract 61–295601, Dec. 26, 1986.

*Primary Examiner*—Anh Mai
*Assistant Examiner*—Jennifer A Poker
(74) *Attorney, Agent, or Firm*—Dean W. Russell; Kilpatrick Stockton LLP

(57) ABSTRACT

A current transformer for alternating current with direct current components is proposed, consisting of at least one transformer core with a primary winding and at least one secondary winding to which a burden resistor is connected in parallel and terminates a secondary circuit with low resistance. The transformer core comprises a closed ring core with no air gap produced from a strip made of an amorphous ferromagnetic alloy that is practically free from magnetostriction and has permeability $\mu<1400$. Particularly appropriate alloys for such a strip ring core have been shown to be cobalt-based alloys consisting essentially of the formula $$Co_a(Fe_{1-x}Mn_x)_bNi_cX_dSi_eB_fC_g.$$

where X is at least one of the elements V, Nb, Ta, Cr, Mo, W, Ge and P, a–g are given in atomic % and whereby a, b, c, d, e, f, g and x satisfy the following conditions:

$40 \leqq a \leqq 82$; $2 \leqq b \leqq 10$; $0 \leqq c \leqq 30$; $0 \leqq d \leqq 5$; $0 \leqq e \leqq 15$; $7 \leqq f \leqq 26$; $0 \leqq g \leqq 3$;

with $15 \leqq d+e+f+g \leqq 30$ and $0 \leqq x<1$.

11 Claims, 8 Drawing Sheets

Typical Data:
$N_{prim}$ 1...6
$I_{prim}$ : 5 $A_{eff}$ ... 120 $A_{eff}$ (max.)
$N_{sec}$ : 500...4000
$i_{sec} \approx -i_{prim} * N_{prim} / N_{sec}$
$R_B$ : 1Ω...200 Ω (Burden)
$R_{cu}$ : 1Ω...200 Ω (Winding)
$U_{signal}$: 300 m $V_{eff}$ (max.)
Frequency: 50/60 Hz Typical Data:
$N_{prim}$ 1...6
$I_{prim}$ : 5 $A_{eff}$ ... 120 $A_{eff}$ (max.)
$N_{sec}$ : 500...4000
$i_{sec} \approx -i_{prim} * N_{prim} / N_{sec}$
$R_B$ : 1Ω...200 Ω (Burden)
$R_{cu}$ : 1Ω...200 Ω (Winding)
$U_{signal}$: 300 m $V_{eff}$ (max.)
Frequency: 50/60 Hz

CURRENT TRANSFORMER WITH DIRECT CURRENT TOLERANCE

FILED OF THE INVENTION

The invention concerns a current transformer for alternating current particularly mains alternating current with direct current components consisting of at least one transformer core with a primary winding and at least one secondary winding to which a burden resistor is connected in parallel and terminates a secondary circuit with low resistance.

BACKGROUND OF THE INVENTION

The power consumption of electrical instruments and apparatus in industrial and domestic use is measured by means of power meters. The oldest principle here utilized is that of the Ferraris wattmeter. The Ferraris wattmeter is based on measuring power through the rotation of a disk connected to a mechanical counter and driven by the current- or voltage-proportional fields of the respective field coils. In order to extend the capability of power meters, for instance for multiple tariff operation or remote control, use is made of electronic power meters in which current and voltage information is obtained by inductive current and voltage transformers. The output signals of these transformers are digitized, multiplied in-phase, integrated and stored. The result is an electrical dimension available for remote reading and other purposes.

On account of the frequently very high currents, that is currents in excess of 100A, the electronic power meters used for measuring power consumption in industrial applications operate indirectly. Special current transformers are connected in front of the current inputs so that only simple bipolar zero-symmetrical alternating currents have to be measured in the meter itself. The current transformers used for this purpose are designed with transformer cores made of highly permeable material. In order to obtain low errors in measurement over a small phase error, these transformers must be provided with very many secondary windings, that is typically more than 2500 secondary windings for 1 primary winding. These are unsuitable for use in domestic meters, which can also be installed in small industrial operations, because modern semiconductor circuits such as rectifier circuits or phase-angle circuits create current flows that are not zero-symmetrical and contain a direct current components This magnetically saturates the current transformer and thus falsifies the power reading.

Known current transformers for mapping such currents operate on the basis of open or mechanically applied air gaps and thus low-permeability magnetic circuits. Since, however, the noise immunity requirements of such current transformers must be very high in order to enable calibrated power measurement, these designs must be provided with costly shielding against external fields. This is demanding in terms of both material and assembly and hence is uneconomical for a wide range of domestic applications.

Another known possible concept is the use of current transformers with relatively impermeable transformer cores, that is transformer cores with permeability $\mu$=2000. Such permeability avoids saturation with small direct current components. A difficulty with these types of current transformers is the balance between the highest non-falsified transmittable effective value of the bipolar zero-symmetrical sine current to be measured and the highest non-falsified transmittable amplitude of a unipolar half-wave rectified sine current. The international standard IEC 1036 applicable in this case provides a ratio for these two dimensions of 1:1.

Achieving this ratio requires the lowest possible permeability. This however causes a high phase error between primary and secondary currents where a practical number of windings is used. As this must be compensated for in the power meter, it requires an appropriate electronic circuit.

In hitherto known current transformer designs the range of compensation is limited to a phase error of 5°. In practice this causes the highest transmittable effective value to be necessarily vastly oversized. Ratios occur of 3–4:1. This leads to very poor use of materials and thus to very high production costs.

In addition this phase error must be maintained with very high linearity over the entire current range to be transmitted in order to keep the cost of compensation as low as possible.

The goal of the present invention, therefore, is to present a current transformer for alternating current with direct current components of the type mentioned at the outset that provides high controllability for both alternating current and direct current components.

SUMMARY OF THE INVENTION

In addition it should provide a highly linear transmittance ratio for precise current measurement over a wide current range.

Moreover it should show high immunity against external magnetic fields without additional shielding precautions so that it can be used economically with simple means, particularly with low mass transformer cores and low winding turn counts, especially for measuring the power consumption of domestic electrical instruments and apparatus.

The goal is achieved according to the invention by means of a current transformer for alternating current with direct current components consisting of at least one transformer core with a primary winding and at least one secondary winding to which a burden resistor is connected in parallel and terminates a secondary circuit with low resistance, specially characterized in that:

1. the transformer core comprises a closed ring core with no air gap produced from a strip (strip ring core) made of an amorphous ferromagnetic alloy;
2. the amorphous ferromagnetic alloy has a magnetostriction value $|\lambda_s|<0.5$ ppm and a permeability $\mu<1400$; and
3. the alloy has a composition consisting essentially of the formula $$Co_a(Fe_{1-x}Mn_x)_bNi_cX_dSi_eB_fC_g.$$

where X is at least one of the elements V, Nb, Ta, Cr, Mo, W, Ge and P, a–g are given in atomic % and whereby a, b, c, d, e, f, g and x satisfy the following conditions:

$40 \leqq a \leqq 82$; $2 \leqq b \leqq 10$; $0 \leqq c \leqq 30$; $0 \leqq d \leqq 5$; $0 \leqq e \leqq 15$; $7 \leqq f \leqq 26$; $0 \leqq g \leqq 3$;

with $15 \leqq d+e+f+g \leqq 30$ and $0 \leqq x<1$.

These measures would produce a current transformer with excellent controllability for both alternating current and direct current components.

It would be further distinguished by a transmittance ratio with high linearity so as to ensure precise current measurement over a very wide current range. Moreover its design with no air gap would provide high immunity against external magnetic fields so that no additional shielding precautions would be necessary. The alloying system according to the invention would enable the achievement of very low mass transformer cores.

With a primary winding count of $n_1=1$ current transformers can be produced with a secondary winding count of about 1500. Altogether according to the invention a current transformer can be produced at extremely low cost that tolerates direct current and is exceptionally suitable for the industrial and domestic applications mentioned at the outset Particularly good current transformers can be produced through the use of amorphous ferromagnetic alloys having a magnetorestrictive value $|\lambda_s|<0.1$ ppm, and permeability $\mu<1200$ where the alloy has a composition consisting essentially of the formula $$Co_a(Fe_{1-x}Mn_x)_bNi_cX_dSi_eB_fC_g.$$

where X is at least one of the elements V, Nb, Ta, Cr, Mo, W, Ge and P, a–g are given in atomic % and whereby a, b, c, d, e, f, g and x satisfy the following conditions:

$50 \leqq a \leqq 75$; $3 \leqq b \leqq 5$; $20 \leqq c \leqq 25$; $0 \leqq d \leqq 3$; $2 \leqq e \leqq 12$; $8 \leqq f \leqq 20$; $0 \leqq g \leqq 3$;

with $17 \leqq d+e+f+g \leqq 25$ and $x \leqq 0.5$.

The alloy systems mentioned above are characterized by linear, flat B-H loops up to a value of H=1 A/cm or greater. The alloy system according to the invention is practically free of magnetostriction. Magnetostriction is preferably suppressed by means of heat treatment whereby the actual saturation magnetostriction is obtained by fine adjustment of the iron and/or manganese content The saturation magnetostriction $B_S$ of 0.7 to 1.2 Tesla is enabled by fine adjustment of the nickel and glass-forming content. Glass-forming is here understood to mean X, silicon, boron and carbon.

Among the amorphous ferromagnetic cobalt-based alloy systems according to the invention, particularly suitable alloys have been shown to be those in which the parameter $a+b+c \geqq 77$ is adjusted to $c \leqq 20$. This enables saturation magnetostriction values $B_S$ of 0.85 Tesla or greater to be readily attained.

The permeability of less than 1400 arises from the physical relationship where permeability $\mu$ is inversely proportional to uniaxial anisotropy $K_U$. The uniaxial anisotropy $K_U$ can be adjusted by means of heat treatment in a transverse magnetic field. The higher the content of cobalt, manganese, iron and nickel, the higher can the uniaxial anisotropy $K_U$ be adjusted. The nickel content here exerts an especially strong effect upon the uniaxial anisotropy $K_U$.

To obtain low permeability an appropriate range of strip thickness for the strip ring core has been shown to be a thickness $d \leqq 30$ $\mu$m, preferably $d \leqq 26$ $\mu$m.

To obtain the best possible linear, flat B-H loop an [appropriate] strip thickness for the strip ring core has been shown to be a thickness $d=\geqq 17$ $\mu$m. In alloys according to the invention this enables the surface-related component of the noise anisotropy to be very significantly reduced.

Typically the strip of the strip ring core has an electrically insulating layer on at least one surface. In another version the entire ring core has an electrically insulating layer. This enables the attainment of especially low permeability values as well as even greater improvement in B-H loop linearity. In selecting the electrically insulating medium, care should be taken that this adheres well to the surface of the strip while causing no reaction on the surface that could lead to degradation of magnetic properties.

Among alloys according to the invention oxides, acrylates, phosphates, silicates and chromates of the elements calcium, magnesium, aluminum, titanium, zirconium, hafnium and silicon have produced particularly effective and compatible electrically insulating media.

Among these, magnesium oxide is particularly effective and economical. It can be applied as a liquid, magnesium-containing precursor product on the surface of the strip. Then by means of a special heat treatment that does not affect the alloy it can be converted into a thick magnesium-containing layer with a thickness D between 25 nm and 400 nm. Actual heat treatment in a transverse magnetic field produces a well-adhering, chemically inert, electrically insulating layer of magnesium oxide.

BRIEF DESCRIPTION OF THE DRAWINGS

The invention is illustrated by way of example in the drawings and described in the following based on said drawings. These are.

DETAILED DESCRIPTION OF THE DRAWINGS

Figure 1:
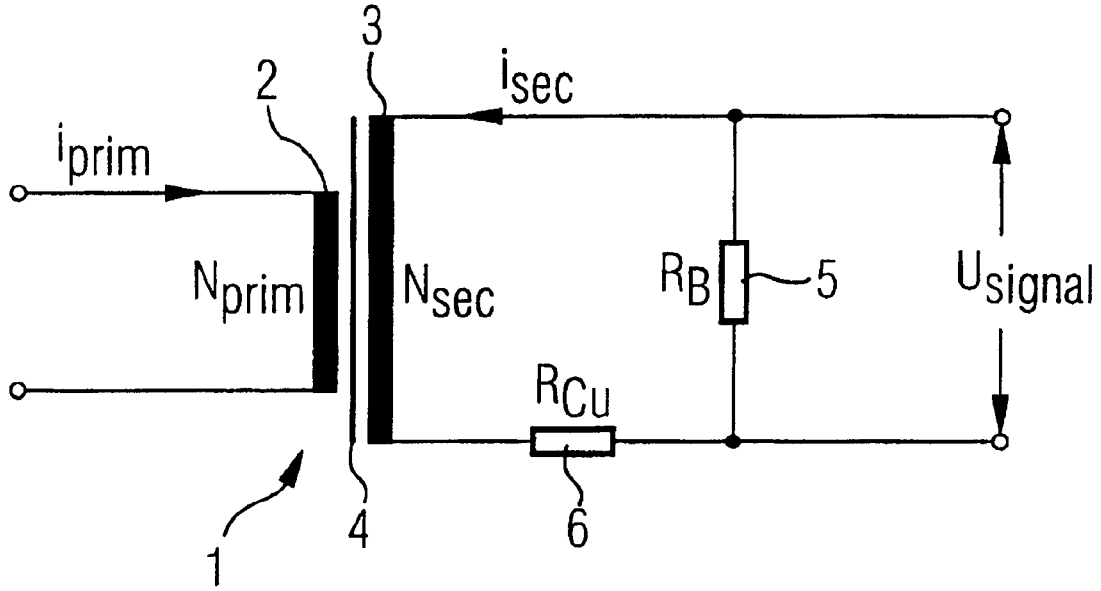
FIG. 1: equivalent circuit diagram of a current transformer and the ranges of technical data that can occur in various applications.

FIG. 1 shows the principal circuit of a current transformer 1. On a transformer core 4 constructed as a ring core is the primary winding 2 leading to the current to be measured $i_{prim}$ and a secondary winding 3 leading to the measuring current $i_{sec}$. The secondary current $i_{sec}$ automatically adjusts itself such that in the ideal situation the primary and secondary ampere windings are equal in size and arranged opposite each other.

The current in the secondary winding 3 then adjusts itself according to the law of induction such that it attempts to hinder the cause of its own occurrence, namely the temporal variation in magnetic flux in the transformer core 4.

In the ideal current transformer the secondary current, multiplied according to its ratio to the number of turns, is opposite but equal to the primary current as seen in Equation (1):

$$I_{sec}^{ideal}=-I_{prim}*(N_{prim}/N_{sec}) \tag{1}$$

Owing to the loss in the burden resistor 5, in the copper resistor 6 of the secondary winding and in the transformer core 4, this ideal situation is never attained.

In real current transformers contrary to the above-mentioned ideal situation the secondary current shows an amplitude error and a phase error as described in Equation (2);

$$F(I) = \frac{I_{sec}^{real} \sim I_{sec}^{ideal}}{I_{sec}^{ideal}} \quad \text{phase error: } \varphi = \phi(I_{sec}^{real}) - \phi(-I_{prim}) \tag{2}$$

An important range of application for current transformers is that of electronic power meters in low-voltage AC circuits with a mains frequency of 50 or 60 Hertz. The evaluation electronics in such meters determine the product of current and voltage at any moment and from that calculate the electric power or power consumption.

Figure 2:
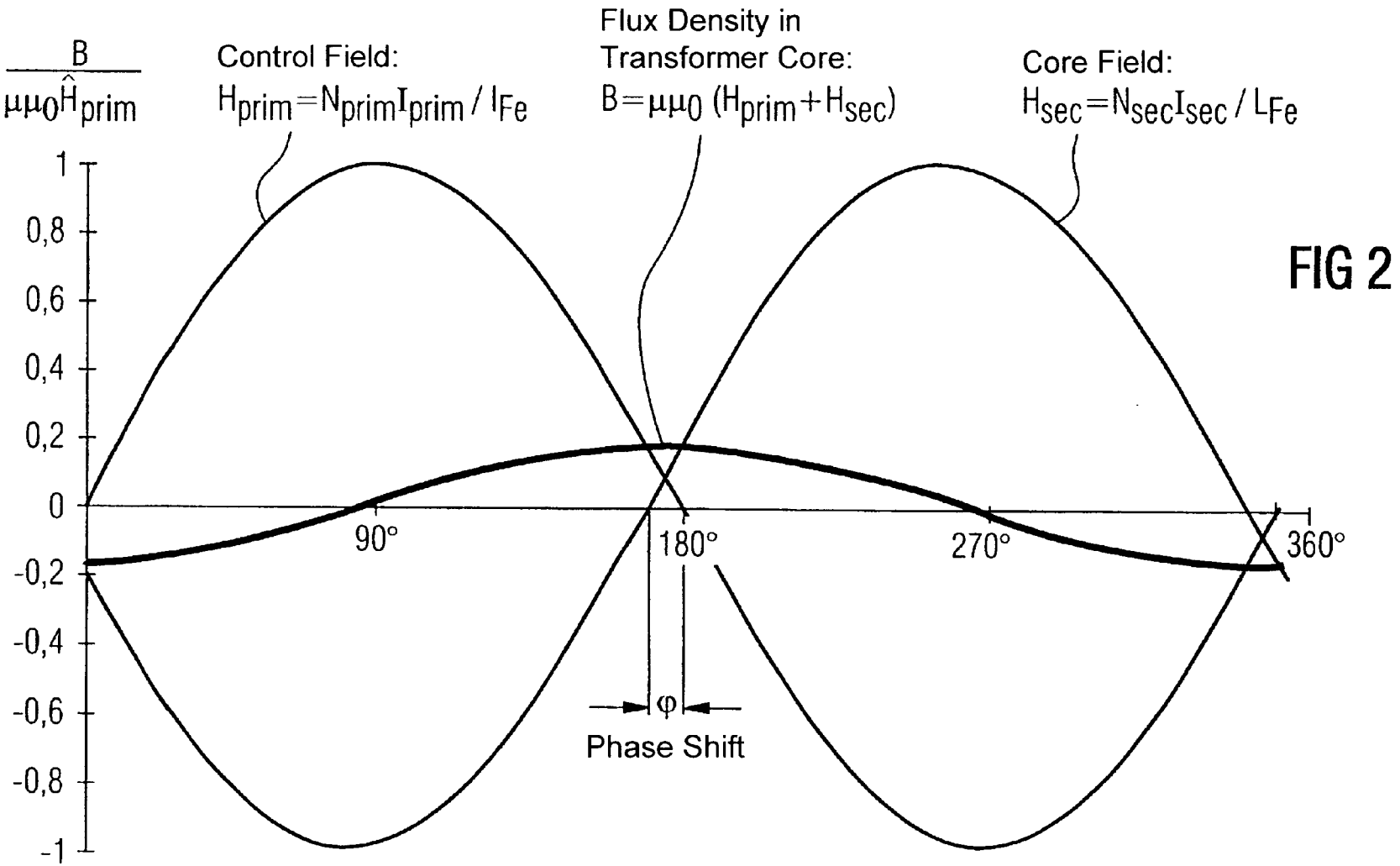
FIG. 2: magnetic fields in a current transformer without consideration of core losses.

Inductive loads very often occur in AC circuits, for example through transformers or motors. If such inductive loads are in open circuit, the phase shift between current and voltage is almost 90°. The consequent effective electric power is 0. In this situation the phase error of the current transformer has a particularly critical effect upon power measurement For this reason it is important to attain either the smallest possible phase error, typically a phase error of $\phi<0.2°$, or a phase error as constant as possible and therefore capable of easy compensation over the range of current measurement In ideal current transformers according to Equation (1) the magnetic fields H of the primary and secondary currents cancel out exactly. Accordingly the transformer core 4 would not experience any magnetic control. Even in real current transformers the two fields approximately compensate each other, so that the magnetic control of the transformer core 4 is very small relative to the magnetic field of the primary current. These relationships are shown in FIG. 2. The smaller the transmission errors of the current transformer, the smaller is the magnetic control of the transformer core 4 relative to the magnetic field of the primary current. This means that a good current transformer can transmit even extremely high currents relative to the field strength of the secondary side of the non-terminated transformer core 4.

The most important characteristic of a current transformer 1 is the ratio of the ohmic resistance in the secondary circuit to the inductive resistance of the secondary winding which is given by Equation (3):

$$Q = \frac{R}{\omega \cdot L} = \tan\varphi \quad (\text{typically } Q = 1/100 \cdots 1/500) \tag{3}$$

This performance factor Q for the current transformer 1, which in the first approximation determines the phase error, should be as small as possible. It equally determines the ratio of the magnetic control B of the transformer core 4 to the magnetic field $H_{prim}$ of the primary current, which is shown in Equation (4):

$$Q = \frac{R}{\omega \cdot L} = \frac{\overline{B}}{\mu\mu_0 \overline{H}_{prim}} \text{ where } R = R_{Cu} + R_R, \tag{4}$$

$$\omega = 2 \cdot \pi \cdot f,\ H = N \cdot L / L_{Fe}$$

For detailed consideration the losses in the transformer core 4 must be taken into account. The core losses depend upon the material properties of the transformer core 4, that is for strip ring cores upon the material, the strip thickness and other parameters. They may be described by a second phase angle δ. The second phase angle δ corresponds to the phase shift between B and H in the transformer core 4 based on core losses. The complete relationships for the characteristics of the current transformer 1 are taken from Equations (5) which describes the phase error and (6) which describes the amplitude error:

$$\text{Phase error: } \tan\varphi = \frac{R}{\omega \cdot L} \cdot \cos\delta \text{ where } L = \mu\mu_0 \frac{A_{Fe}}{L_{Fe}} \cdot N_{sec}^2 \tag{5}$$

-continued $$\text{Amplitude error: } F(I) = -\frac{R}{\omega \cdot L} \cdot \sin\delta \tag{6}$$

$L_{Fe}$=iron path length (mid-range).

$A_{Fe}$=iron cross-section of ring core

The properties of the core material comprise the relative permeability $\mu$ and the loss angle δ or the loss factor tan δ. These material properties depend strongly upon the magnetic control B of the transformer core and thereby upon the primary current This is the cause of the non-linearity of the transformer characteristics.

Electric power meters utilized for domestic billing purposes often require so-called direct current tolerance. What is implied here is not a real direct current but rather an asymmetrical alternating current, which can arise for instance through a diode in a user circuit.

The international standard IEC 1036 requires the electric power meter to be functionally capable although with limited accuracy even in the case of fully half-wave rectified alternating current. That corresponds to a situation where the entire primary current flows through a diode.

Figure 3:
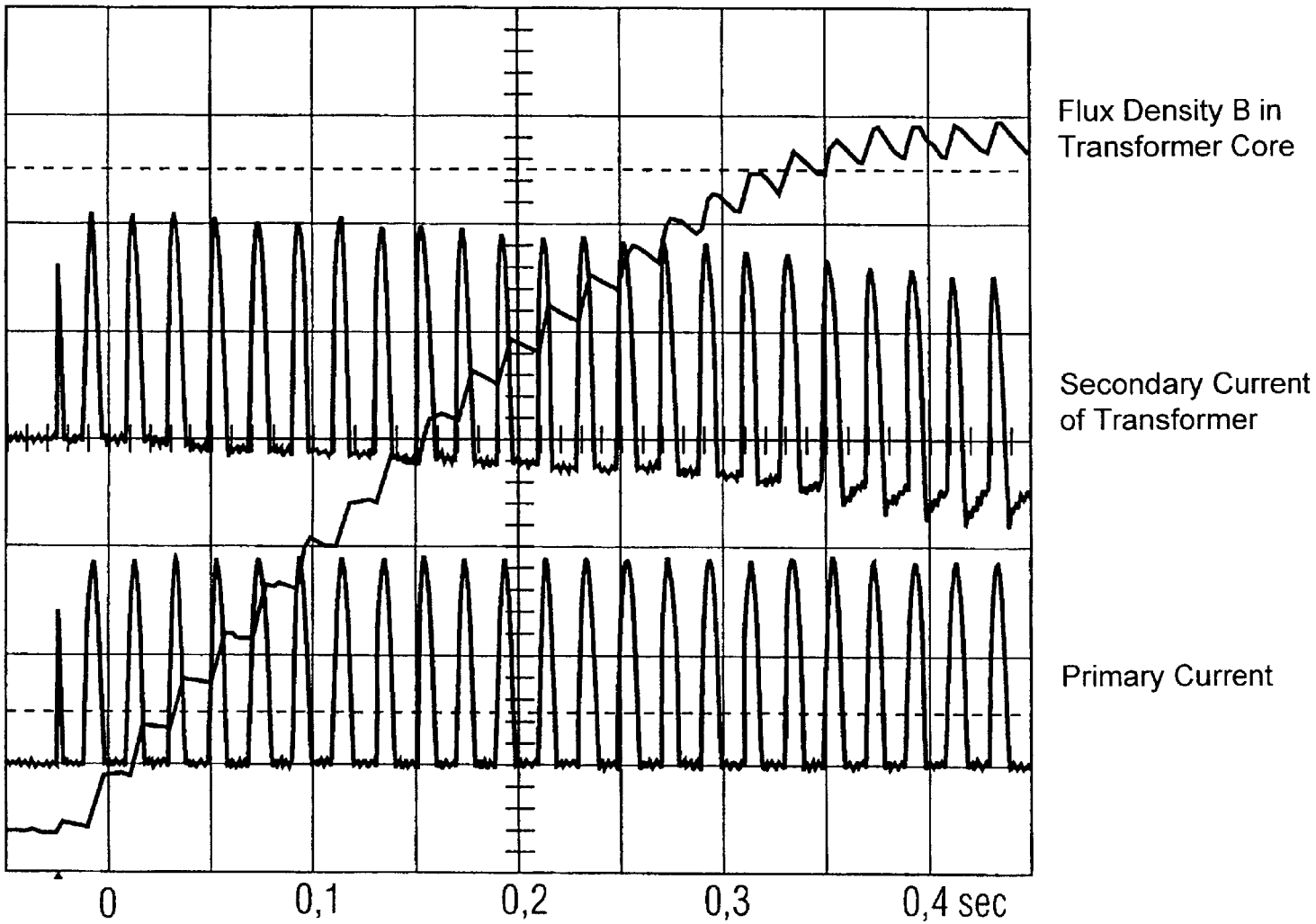
FIG. 3: oscillogram of the secondary current of a current transformer with half-wave rectified primary current.

FIG. 3 shows an oscillogram of the primary and secondary currents of a current transformer and the flux density B in a transformer core for a half-wave rectified primary current As can be seen, the flux density B in the transformer climbs stepwise with each half wave until the transformer core reaches saturation.

The effect of such a form of current on the transformer can be described based on FIG. 3:

During a half period the flux density in the transformer core increases by the value:

$$\Delta B_1 = 2\overline{B} = 2\frac{R}{\omega \cdot L} \cdot \mu\mu_0 \overline{H}_{prim} \tag{7}$$

For control with a symmetrical alternating current exactly the same flux density is reduced during the next half period. Should the driving force of the primary current now fail during this second half period, the flux in the core can drop only very slowly. This drop follows an exponential law:

$$B = B_0(1 - \exp(-1/\tau)) \tag{8}$$

where the secondary winding time constant $\tau = L/R$

This time constant is exactly the same value if the transformer displays a high performance factor according to Equation (3). In good current transformers it lies in the range of seconds. With initial value $B_0$ during the period $T=1/f=2\pi/\omega$ the flux density drops, discharged approximately by this $$\Delta B_2 = B_0 \cdot 2\pi \cdot \frac{R}{\omega \cdot L} \tag{9}$$

which is small relative to $\Delta B_1$.

That is, the next period begins with the core flux density already raised, so that from one period to another the core acquires a higher magnetic flux density $B_0$. The mean equilibrium flux density is calculated by equating Equations (7) and (9) to:

$$\overline{B} = \frac{1}{\pi}\mu\mu_0\overline{H}_{prim} = \frac{1}{\pi}\mu\mu_0\frac{\overline{I}_{prim}}{L_{Fe}} \quad (10)$$

If the equilibrium value B is still within the linear range of the magnetization curve of the transformer core, the half-wave rectified current will also be transmitted without increased error. This is indeed the case for very small current amplitudes. At higher current the transformer core reaches the phase of transition to saturation. There the permeability $\mu$ drops suddenly so that a state of equilibrium arises in the bend of the magnetization curve with sharply increased error up to complete overload.

With transformer cores made of crystalline alloys and ferrites there is no practical solution to this problem.

On the other hand excellent results can be obtained according to the invention with transformer cores made of at least 70% amorphous, ferromagnetic, cobalt-based alloys that are practically free from magnetostriction. These cobalt-based alloys show a flat, practically linear B-H loop with permeability $\mu$<1400. The transformer cores are preferably constructed as closed strip ring cores in oval or rectangular shape with no air gap.

The following Table shows two appropriate alloy compositions:

| Alloy At. % | Saturation Induction $\mathfrak{m}$ | Permeability $\mu$ | Saturation Magnetostriction $\lambda$ As quenched | Saturation Magnetostriction $\lambda$ Heat treated | Crystallization Temperature ° C. |
|---|---|---|---|---|---|
| Co72.8 Fe4.7 Si5.5 B17 | 0.99 | 1220 | $-32° 10^{-8}$ | $-1.6° 10^{-8}$ | 500 |
| Co55.6 Fe6.1 Mn1.1 Si4.3 B15.2 Ni16.5 | 0.93 | 710 | $-110° 10^{-8}$ | $+4.2° 10^{-8}$ | 432 |

The amorphous, ferromagnetic, cobalt-based alloys shown in Table 1 are produced initially as an amorphous strip from a melt by means of the known as-quenched technology. As-quenched technology is described in detail in for example DE 3731781 C1. The strip, having a thickness of about 20 $\mu$m, is then coiled free from tension into a strip ring core.

Adjustment of the linear, flat B-H loop according to the invention is then carried out by means of a special heat treatment of the coiled strip ring core in a magnetic field aligned vertically to the direction of the strip. The heat treatment is so arranged that the saturation magnetostriction value of the as-quenched strip during heat treatment changes in a positive direction by an amount dependent upon the alloy composition until it reaches the range shown in Table 1.

Figure 5:
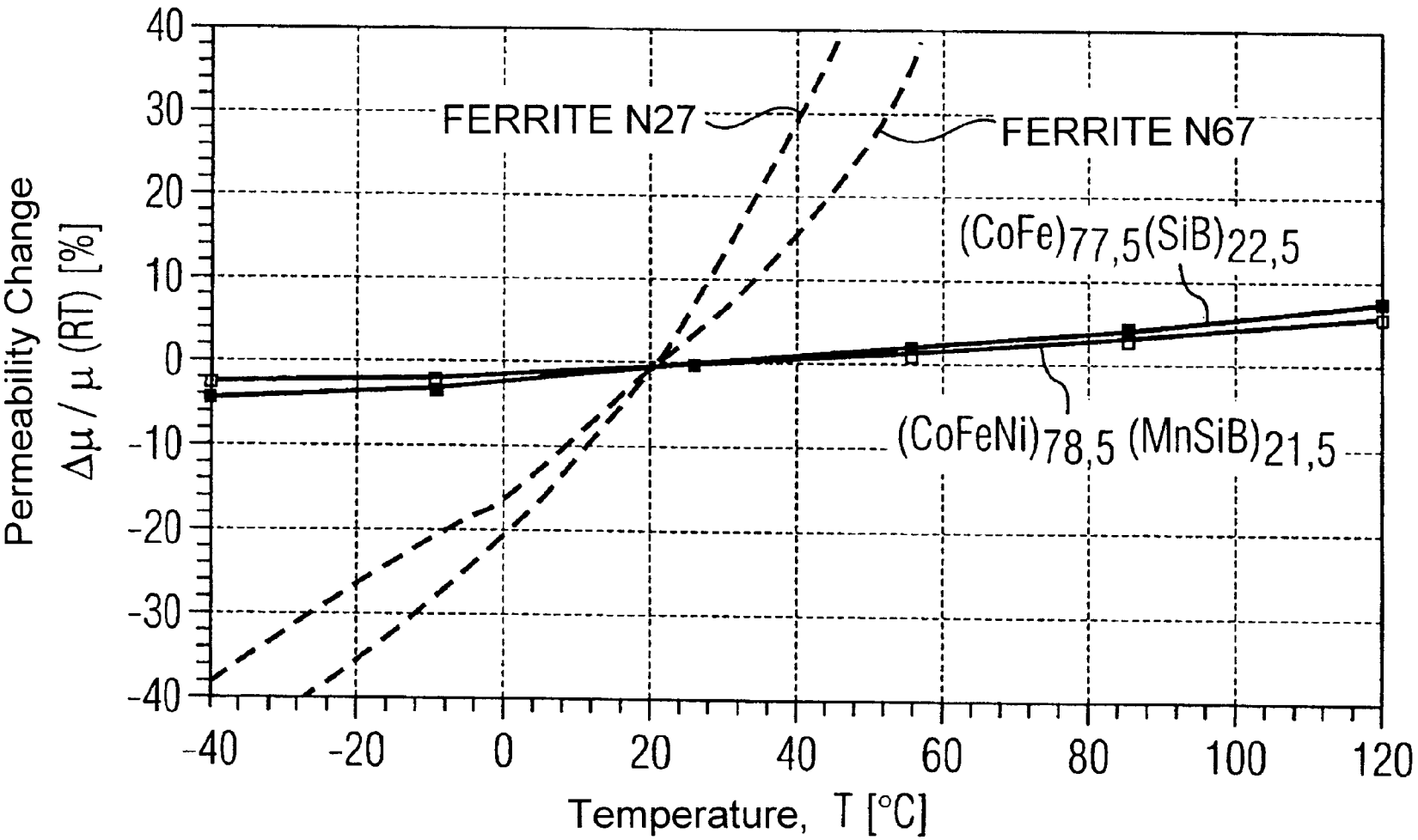
FIG. 5: change in permeability as a function of temperature.

For example, in the case of an alloy composed of Co72.7, Fe4.6, Si5.5, B17.2, the heat treatment shown in FIG. 5 was found to shift the strongly negative magnetostriction value of $\lambda_S=-45\times10^{-8}$ for the as-quenched snip in a positive direction almost up to the zero transit ($\lambda_S=-2\times10^{-8}$). At the same time a highly linear F loop arose with an almost ideal permeability value of 1200 and a saturation induction $B_S$=0.998 T. By F loop is meant a hysteresis loop showing a ratio of remanence $B_\tau$ to saturation induction $B_S$<50.

Where however the transverse field temperature of 330° C. fell to for example 310° C., the permeability fell to an excessively low level of 1100, while the magnetostriction lay at about $-10\times10^{-8}$, far from the zero transit point This adversely affected the linearity of the $\mu(\overline{B})$ characteristic curve while the phase error climbed by 10%.

If on the other hand the transverse field temperature was increased to 370° C., the magnetostriction value climbed to $\lambda_S=+8\times10^{-8}$. At the same time the permeability climbed to a comparably high value of $\mu$=1300, lowering the direct current tolerance. Furthermore at this temperature the first maturation process of the seed crystals already present in the as-quenched strip began, leading to a significant interruption in the linearity of the characteristic curve.

During heat treatment the strip ring core was bathed in a protective gas, so that no oxidation or other chemical reactions took place on the strip surface that would have adversely affected tie physical properties of the strip ring core.

The coiled strip ring core was heated under a magnetic field at a rate of 1 to 10 Kelvin/min. τ0 a temperature about 300° C., well below the stated Curie temperature. It was maintained within this temperature interval for several hours in the applied transverse magnetic field. It was then cooled down again at a cooling rate of 0.1 to 5 Kelvin/min.

To obtain the linear and very flat B-H loops according to the invention the applied magnetic field was strong enough that the temperature-dependent saturation induction of the respective alloy was safely exceeded at every point within the strip ring core. The thus treated strip ring cores were finally stiffened by sheathing with plastic.

A prerequisite for the production of very small but very high precision current transformers is that the amplitude permeability $\mu$ of the core of the current transformer in the control range of 1 mT≦$\overline{B}$0.9 $B_S$ changes by less than 6%, preferably by less than 4%. This linearity requirement can be maintained through the production method described on condition that the strip material employed possesses a relative surface roughness $R_{a\ rel}$.

Figure 8:
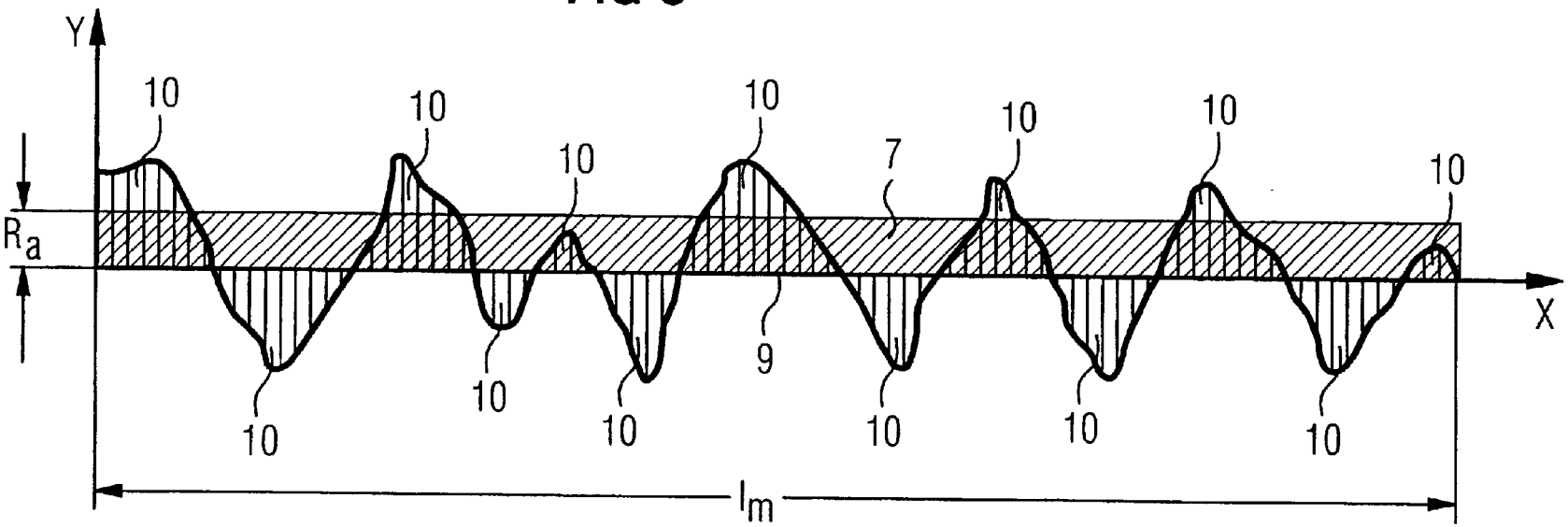
FIG. 8: cross-sectional view through the surface of a body whose roughness is to be determined.

The definition of $R_{a\ rel}$ is explained as follows based on FIG. 8. Here the x-axis lies parallel to the surface of a body for which the surface roughness is to be determined. The y-axis on the other hand lies parallel to the surface norm of the surface to be measured. The surface roughness $R_a$ thus corresponds to the height of a rectangle 7 of which the length is equal to a total measuring path $l_m$ and the area of which is equal to the sum of the areas 10 enclosed between a roughness outline 8 and a median line 9. The surface roughness $R_{a\ rel}$ on both sides of the thickness of the strip material is then obtained from the formula $R_{a\ rel}$=($R_a$ upper side+$R_a$ lower side)/d where d is the thickness of the strip material.

A strip ring core weighing only 4.7 g could be produced from the alloy Co72.8, Fe4.7, Si5.5, B17 and provided with a secondary winding with a turns count $n_{sec}$ of 1000. The current transformer thus produced showed a phase angle linearity of 0.2° over a current range of <120 mA to 120 A. The permeability of this strip ring core was $\mu$=1150. The strip ring core dimensions were 24.5×20.5×5.5 mm with an iron cross section of $A_{Fe}$=0.088 $cm^2$.

Figure 6:
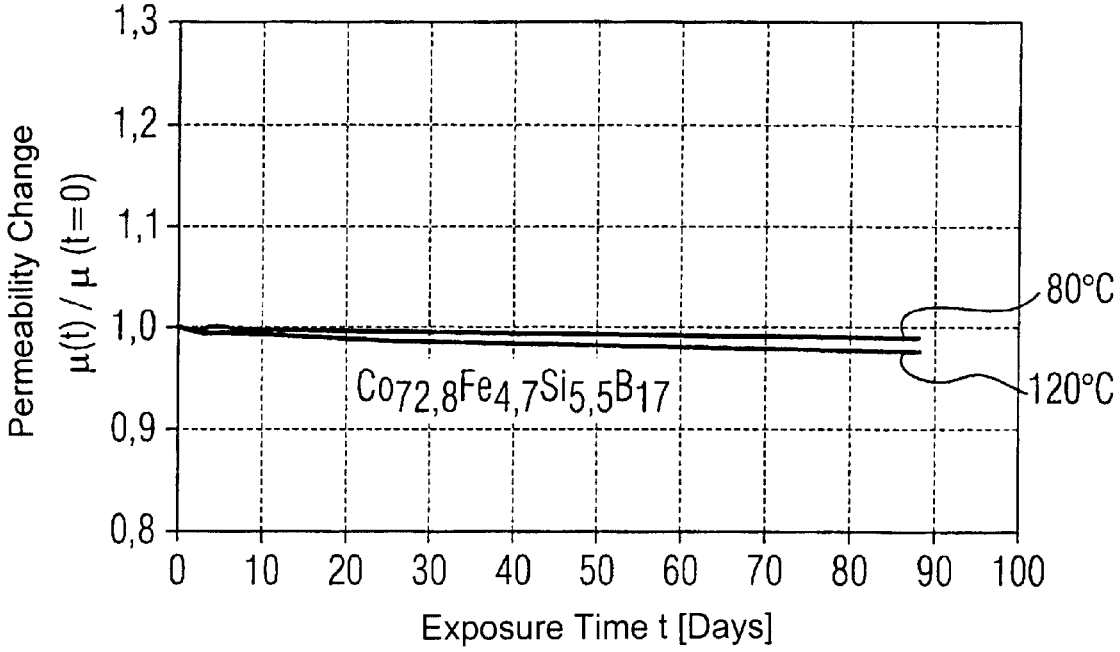
FIG. 6: change in permeability as a function of exposure time of alloys according to the invention.
Figure 7:
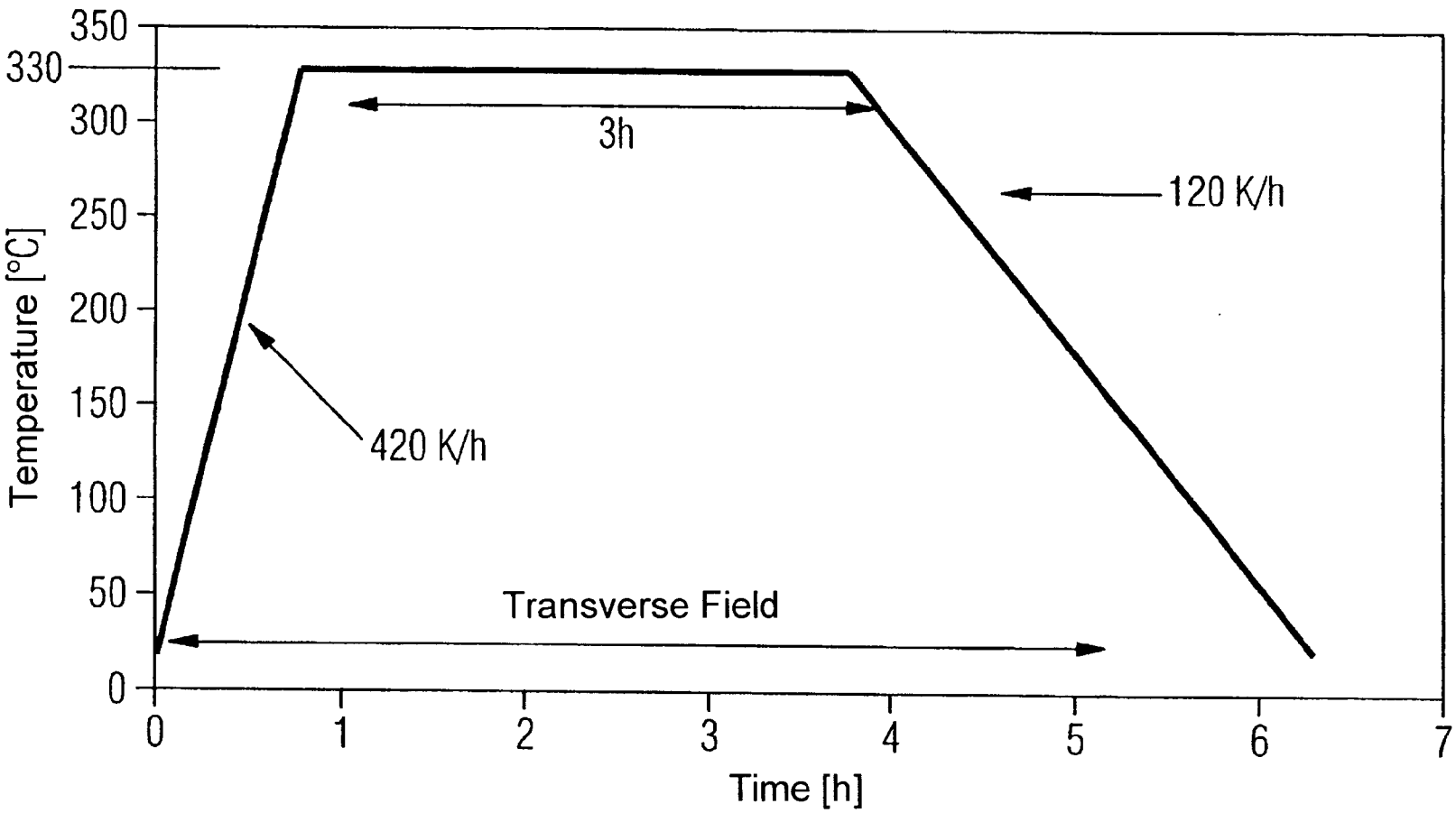
FIG. 7: diagram of a possible temperature slope during heat treatment.

The current transformer produced with this strip ring core showed a phase error of 8.90°+/−0.1° over the entire current range. The relationship between the highest transmittable effective value of the bipolar zero-symmetrical sine current to be measured and the highest transmittable amplitude of a unipolar half-wave rectified sine current was 1.4:1. Moreover the strip ring core showed very good change characteristics at 120° C. as shown in FIG. 6, which can be explained by the very high crystallization temperature and the high anisotropy energy of this alloy.

In the production of this strip ring core special value was placed on careful adaptation of the coiling technique and heat treatment to the magnetic and metallurgical properties of the alloys. Particular attention was paid to ensuring that the coiled strip ring cores were safely saturated in the transverse direction at every point, which was achieved by stacking several strip ring cores end to end. The directional deviation of the field lines from the axis of rotational symmetry of the stack of strip ring cores was about 0.5°. It has been shown that a deviation of maximum 3° is permissible.

Figure 4:
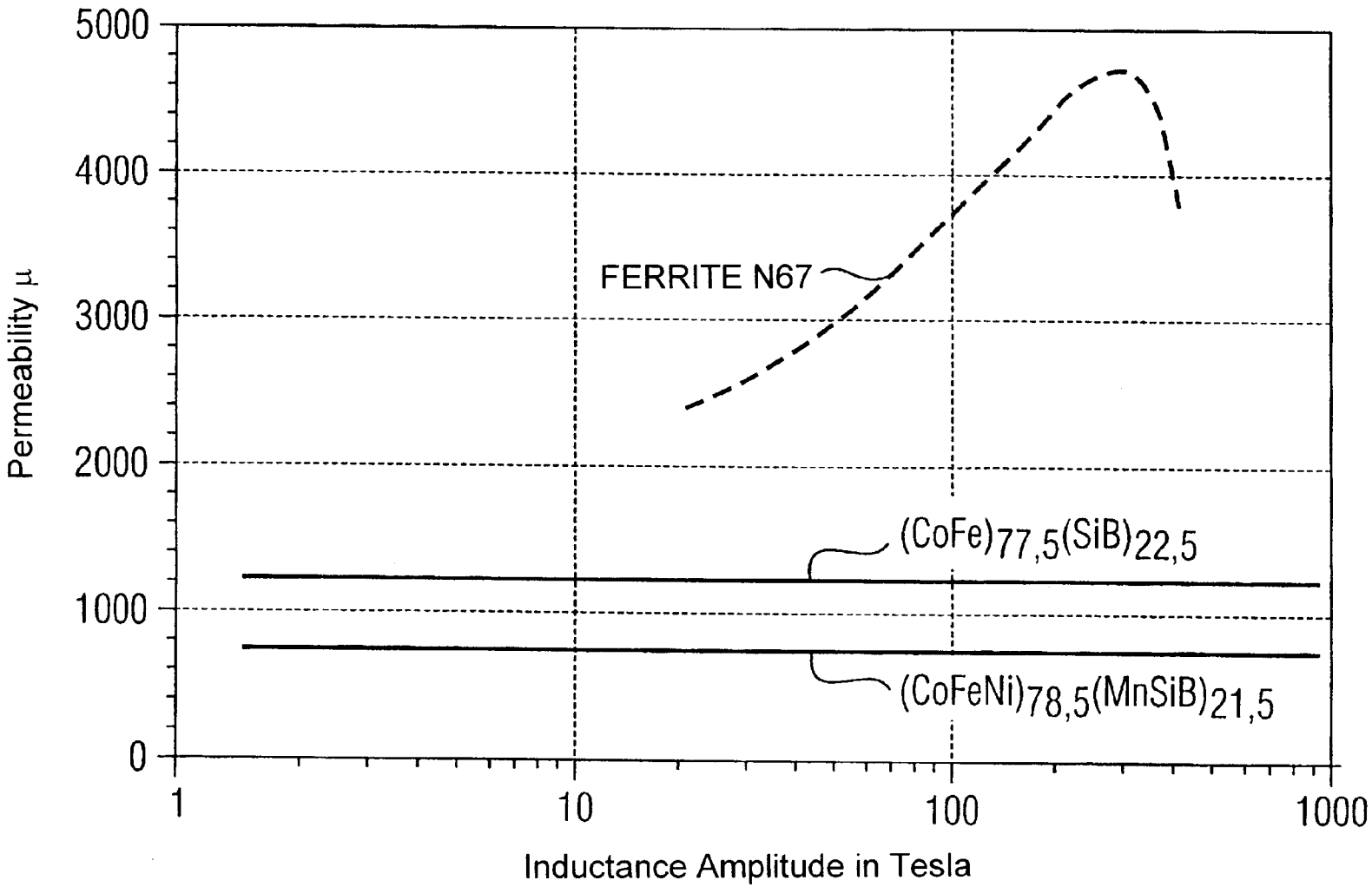
FIG. 4: permeability as a function of induction amplitude.

As can be seen from FIG. 4, the range of alloys according to the invention allows permeability values to be adjusted between 500 and 1400. As shown in FIG. 5, the use of the alloy systems as claimed allows very high permeability temperature stability to be attained. Thus for example the typical change between ambient temperature and +100° C. is less than 5%.

It can her be seen from FIGS. 4 and 5 that the dependence of permeability on control or temperature is significantly more favorable than for ferrites (N67 or N27). The strong dependence of permeability on control or temperature is particularly noticeable, such that for current transformers with cores made of ferrite it is difficult to linearize the characteristic curve owing to shearing and hence an air gap. An air gap in the transformer core creates the danger of inducing interference voltage through externally located magnetic fields. Moreover the influence of temperature on sheared transformer cores made of ferrite can lead to an undefined change in the air gap and thus to an excessive change in inductance.

The present invention allows cost-effective production of compact-style current transformers for industrial and domestic use, provided with secondary windings having turns counts $n_{sec} \leqq 1500$ for a primary winding $n_{prim}=1$ and for a primary current $i_{prim}<120$ A.

What is claimed is:

1. Current transformer for alternating current with direct current components consisting of at least one transformer core with a primary winding and at least one secondary winding to which a burden resistor is connected in parallel and terminates a secondary circuit with low resistance, specially characterized in that the transformer core comprises a closed ring core with no air gap produced from a strip made of an amorphous ferromagnetic alloy;

the amorphous ferromagnetic alloy has a magnetostriction value $|\lambda_S|<0.5$ ppm and permeability $\mu<1400$; and the alloy has a composition consisting essentially of the formula $$Co_a(Fe_{1-x}Mn_x)_bNi_cX_dSi_eB_fC_g.$$

where X is at least one of the elements V, Nb, Ta, Cr, Mo, W, Ge and P, a–g are given in atomic % and whereby a, b, c, d, e, f, g and x satisfy the following conditions:

$40 \leqq a \leqq 82$; $2 \leqq b \leqq 10$; $0 \leqq c \leqq 30$; $0 \leqq d \leqq 5$; $0 \leqq e \leqq 15$; $7 \leqq f \leqq 26$; $0 \leqq g \leqq 3$;

with $15 \leqq d+e+f+g \leqq 30$ and $0 \leqq x<1$.

2. Current transformer as in claim 1 specially characterized in that a, b, c, d, e, f, g and x satisfy the following conditions:

$50 \leqq a \leqq 75$; $3 \leqq b \leqq 10$; $5 \leqq c \leqq 25$; $0 \leqq d \leqq 3$; $2 \leqq e \leqq 12$; $8 \leqq f \leqq 20$; $0 \leqq g \leqq 3$;

with $17 \leqq d+e+f+g \leqq 25$ and $x \leqq 0.5$.

3. Current transformer as in claim 2 specially characterized in that a, b and c satisfy the following conditions:

$a+b+c \geqq 77$ and $c \leqq 20$.

4. Current transformer as in claim 3 specially characterized in that the amorphous ferromagnetic alloy has a magnetostriction value $|\lambda_S|<0.1$ ppm and permeability $\mu<1300$.

5. Current transformer as in claim 1 specially characterized in that the amorphous ferromagnetic alloy has a saturation magnetization $B_S$ of 0.7 to 1.2 Tesla.

6. Current transformer as in claim 1 specially characterized in that the strip has a thickness d of 17 $\mu m \leqq d \leqq 30$ $\mu m$.

7. Current transformer as in claim 1 specially characterized in that the strip is provided with an electrically insulating layer on at least one surface.

8. Current transformer as in claim 1 specially characterized in that the ring core is provided with an electrically insulating layer.

9. Current transformer as in claim 7 specially characterized in that the electrically insulating layer consists of a layer of magnesium oxide.

10. Current transformer as in claim 9 specially characterized in that the magnesium oxide layer has a thickness D of 25 nm $\leqq D \leqq$ 400 nm.

11. Current transformer as in claim 1 specially characterized in that the secondary winding has turns counts $n_{sec} \leqq 1500$ where the primary winding has turns count $n_{prim}=1$ and the current transformer is designed for a primary current $i_{prim}<120$ A.

* * * * *